US005684926A

United States Patent [19]

Huang et al.

[11] Patent Number: 5,684,926

[45] Date of Patent: Nov. 4, 1997

[54] MBE SYNTHESIZER FOR VERY LOW BIT RATE VOICE MESSAGING SYSTEMS

[75] Inventors: Jian-Cheng Huang, Lake Worth; Xiaojun Li, Boynton Beach; Floyd Simpson, Lantana, all of Fla.

[73] Assignee: Motorola, Inc., Schaumburg, Ill.

[21] Appl. No.: 592,252

[22] Filed: Jan. 26, 1996

[51] Int. Cl.[6] ..... G10L 5/02

[52] U.S. Cl. ..... 395/2.77; 395/2.17; 395/2.73

[58] Field of Search ..... 395/2.67, 2.71, 395/2.73, 2.77, 2.16, 2.14, 2.17, 2.74, 2.09

[56] References Cited

U.S. PATENT DOCUMENTS

| | | | |
|---|---|---|---|
| 4,885,790 | 12/1989 | McAulay et al. | 395/2.74 |
| 4,937,873 | 6/1990 | McAulay et al. | 395/2.74 |
| 5,081,681 | 1/1992 | Hardwick et al. | 395/2.77 |
| 5,195,166 | 3/1993 | Hardwick et al. | 395/2.09 |
| 5,216,747 | 6/1993 | Hardwick et al. | 395/2.17 |
| 5,226,108 | 7/1993 | Hardwick et al. | 395/2.09 |
| 5,574,823 | 11/1996 | Hassanein et al. | 395/2.17 |
| 5,630,011 | 5/1997 | Lim et al. | 395/2.14 |

*Primary Examiner*—Kee M. Tung
*Attorney, Agent, or Firm*—Philip P. Macnak

[57] ABSTRACT

An MBE synthesizer (116) for generating a segment of speech from compressed speech data received by a receiver (2004). The compressed speech data includes one or more indexes (2240, 2242) and pitch data (2248). The MBE synthesizer (116) includes the following: an excitation generator (2222) utilizing a transform function for generating transformed excitation components responsive to the pitch data (2248). A memory (3006) for storing a table of predetermined spectral vectors (2205) and associated predetermined voicing vectors (2203). A harmonic amplitude estimator (2209) that is responsive to the one or more predetermined spectra/vectors identified by the indexes (2240, 2242) received, that generates harmonic amplitude control signals. The harmonic amplitude estimator (2209) which includes a peak detector (2503), a peak enhancer (2505), a valley detector (2507), a valley enhancer (2509). A multi-band voicing controller (2214), responsive to the predetermined voicing vectors which are associated with the one or more predetermined spectral vectors identified, for controlling a selection of the excitation components.

30 Claims, 11 Drawing Sheets

108

MBE SYNTHESIZER FOR VERY LOW BIT RATE VOICE MESSAGING SYSTEMS

CROSS REFERENCE TO RELATED CO-PENDING APPLICATIONS

Related co-pending patent application Ser. No. 08/511,995, filed concurrently herewith, by Huang, et al., entitled "Very Low Bit Rate Time Domain Speech Analyzer For Voice Messaging" which is assigned to the Assignee hereof.

FIELD OF THE INVENTION

This invention relates generally to MBE synthesizers for use in communication receivers, and more specifically to an improved MBE synthesizer which utilizes very low bit rate data transmission rates in a compressed voice digital communication system to obtain high quality voice messages.

BACKGROUND OF THE INVENTION

Communications systems, such as paging systems, have had to in the past compromise the length of messages, number of users and convenience to the user in order to operate the systems profitably. The number of users and the length of the messages were limited to avoid over crowding of the channel and to avoid long transmission time delays. The user's convenience is directly affected by the channel capacity, the number of users on the channel, system features and type of messaging. In a paging system, tone only pagers that simply alerted the user to call a predetermined telephone number offered the highest channel capacity but were some what inconvenient to the users. Conventional analog voice pagers allowed the user to receive a more detailed message, but severally limited the number of users on a given channel. Analog voice pagers, being real time devices, also had the disadvantage of not providing the user with a way of storing and repeating the message received. The introduction of digital pagers with numeric and alphanumeric displays and memories overcame many of the problems associated with the older pagers. These digital pagers improved the message handling capacity of the paging channel, and provide the user with a way of storing messages for later review.

Although the digital pagers with numeric and alpha numeric displays offered many advantages, some user's still preferred pagers with voice announcements. In an attempt to provide this service over a limited capacity digital channel, various digital voice compression techniques and synthesis techniques have been tried, each with their own level of success and limitation. Voice compression methods, based on vocoder techniques, currently offer a highly promising technique for voice compression. Of the low data rate vocoders, the multi band excitation (MBE) vocoder is among the most natural sounding vocoder.

The vocoder analyzes short segments of speech, called speech frames, and characterizes the speech in terms of several parameters that are digitized and encoded for transmission. The speech characteristics that are typically analyzed include voiding characteristics, pitch, frame energy, and spectral characteristics. Vocoder synthesizers used these parameters to reconstruct the original speech by mimicking the human voice mechanism. Vocoder synthesizers modeled the human voice as an excitation source, controlled by the pitch and frame energy parameters followed by a spectrum shaping controlled by the spectral parameters.

The voicing characteristic describes the repetitiveness of the speech waveform. Speech consists of periods where the speech waveform has a repetitive nature and periods where no repetitive characteristics can be detected. The periods where the waveform has a periodic repetitive characteristic are said to be voiced. Periods where the waveform seems to have a totally random characteristic are said to be unvoiced. The voiced/unvoiced characteristics are used by the vocoder speech synthesizer to determine the type of excitation signal which will be used to reproduce that segment of speech. Due to the complexity and irregularities of human speech production, no single parameter can reliably determine when a speech frame is voiced or unvoiced.

Pitch defines the fundamental frequency of the repetitive portion of the voiced wave form. Pitch is typically defined in terms of a pitch period or the time period of the repetitive segments of the voiced portion of the speech wave forms. The speech waveform is a highly complex waveform and very rich in harmonics. The complexity of the speech waveform makes it very difficult to extract pitch information. Changes in pitch frequency must also be smoothly tracked for an MBE vocoder synthesizer to smoothly reconstruct the original speech. Most vocoders employ a time-domain auto-correlation function to perform pitch detection and tracking. Auto-correlation is a very computationally intensive and time consuming process. It has also been observed that conventional auto-correlation methods are unreliable when used with speech derived from a telephone network. The frequency response of the telephone network (300 Hz to 3400 Hz) causes deep attenuation of the lower harmonics of a speaker having a low pitch frequency (the range of the fundamental frequency of the human voice is 50 Hz to 400 Hz). Because of the deep attenuation of the fundamental frequency, pitch trackers can erroneously identify the second or third harmonic as the fundamental frequency. The human auditory process is very sensitive to changes in pitch and the perceived quality of the reconstructed speech is strongly effected by the accuracy of the pitch derived.

Frame energy is a measure of the normalized average RMS power of the speech frame. This parameter defines the loudness of the speech during the speech frame.

The spectral characteristics define the relative amplitude of the harmonics and the fundamental pitch frequency during the voiced portions of speech and the relative spectral shape of the noise like unvoiced speech segments. The data transmitted defines the spectral characteristics of the reconstructed speech signal. Non optimum spectral shaping results in poor reconstruction of the voice by an MBE vocoder synthesizer and poor noise suppression.

The human voice, during a voiced period, has portions of the spectrum that are voiced and portions that are unvoiced. MBE vocoders produce natural sounding voice because the excitation source, during a voiced period, is a mixture of voiced and unvoiced frequency bands. The speech spectrum is divided into a number of frequency bands and a determination is made for each band as to the voiced/unvoiced nature of each band. The MBE speech synthesizer generates an additional set of data to control the excitation of the voiced speech frames. In conventional MBE vocoders, the band voiced/unvoiced decision metric is pitch dependent and computationally intensive. Errors in pitch may lead to errors in the band voiced/unvoiced decision that will affect the synthesized speech quality. Transmission of the band voiced/unvoiced data also substantially increases the quantity of data that must be transmitted.

Conventional MBE synthesizers require information on the phase relationship of the harmonic of the pitch signal to accurately reproduce speech. Transmission of phase information, further increasing the data required to be transmitted.

Conventional MBE synthesizers can generate natural sounding speech at a data rate of 2400 to 6400 bit per second. MBE synthesizers are being used in a number of commercial mobile communications systems, such as the INMARSAT (International Marine Satellite Organization) and the ASTRO™ portable transceiver manufactured by Motorola Inc. of Schaumburg, Ill. The standard MBE vocoder compression methods, currently used very successfully by two way radios, fail to provide the degree of compression required for use on a paging channel. Voice messages that are digitally encoded using the current state of the art would monopolize such a large portion of the paging channel capacity that they may render the system commercially unsuccessful.

Portable communication devices such as paging receivers are typically battery powered. Most paging receivers are powered by a single cell battery such that highly computational processes such as speech synthesizers that require high speed digital signals adversely affect battery life.

Accordingly, what is needed for optimal utilization of a channel in a communication system, such as a paging channel in a paging system or a data channel in a non-real time one way or two way data communications system, is an MBE synthesizer to accurately reproduce voice from compressed data, where the phase and voicing information has been reduced or eliminated from the transmitted data. Also what is needed is an MBE synthesizer that will compensate for non optimum spectral shaping and spectral components caused by poor noise suppression at the encoder by enhances the spectral shaping thus improving clarity and reducing noise. Furthermore there is a need to reduce the computational intensity within the MBE synthesizer for very highly compressed voice messages while maintaining acceptable speech quality.

SUMMARY OF THE INVENTION

Briefly, according to a first aspect of the invention, an MBE synthesizer generates a segment of speech from compressed speech data which is received by a receiver that is coupled to the MBE synthesizer. The compressed speech data received includes one or more indexes. The MBE synthesizer includes an excitation generator, a memory, a harmonic amplitude estimator, a multi-band voicing controller and a multiplier. The excitation generator generates voiced excitation components and unvoiced excitation components. The memory stores a table of predetermined spectral vectors which are identified by the indexes, a portion of the table of the predetermined spectral vectors stored is associated with predetermined voicing vectors. The harmonic amplitude estimator is responsive to the one or more predetermined spectral vectors identified by the indexes received for generating harmonic amplitude control signals. The multi-band voicing controller is responsive to the predetermined voicing vectors which are associated with the one or more predetermined spectral vectors identified for controlling a selection of the excitation components. The multiplier multiplies the harmonic amplitude control signals and the excitation components selected to generate special components representing the segment of speech.

Briefly, according to a second aspect of the present invention, an MBE synthesizer generates a segment of speech from compressed speech data which is received by a receiver which is coupled to the MBE synthesizer. The compressed speech data received includes one or more indexes and pitch dam. The MBE synthesizer includes an excitation generator, a memory, a harmonic amplitude estimator, a multi-band voicing controller and a multiplier. The excitation generator is responsive to the pitch data and utilizes a transform function to generate transformed voiced excitation components and transformed unvoiced excitation components. The memory stores one or more tables of predetermined spectral vectors that are identified by the indexes received. The harmonic amplitude estimator generates harmonic amplitude control signals, and is responsive to one or more predetermined spectral vectors that are identified by indexes received. The multi-band voicing controller controls a selection of the transformed voiced excitation components and transformed unvoiced excitation components the multiplier multiplies the harmonic amplitude control signals and the transformed voiced excitation components and transformed unvoiced excitation components selected to generate spectral components representing the segment of speech.

Briefly, according to a third aspect of the invention, an MBE synthesizer generates a segment of speech from compressed speech data which is received by a receiver which is coupled to the MBE synthesizer. The compressed speech data received includes one or more indexes and pitch data. The MBE synthesizer includes an exaltation generator, a memory, a harmonic amplitude estimator, a multi-band voicing controller and a multiplier. The excitation generator is responsive to the pitch data for generating transformed voiced excitation components and transformed unvoiced excitation components. The memory stores one or more tables of predetermined spectral vectors that are identified by the indexes. The harmonic amplitude estimator is responsive to one or more predetermined spectral vectors identified by indexes corresponding to the one or more indexes received, and generates harmonic amplitude control signals which are associated with harmonics defined by the pitch data received. The multi-band voicing controller controls a selection of the transformed voiced excitation components and transformed unvoiced excitation components. The multiplier multiplies the harmonic amplitude control signals, the transformed voiced excitation components and transformed unvoiced excitation components selected to generate spectral components representing the segment of speech. The harmonic amplitude estimator also includes a peak detector a peak enhancer, a valley detector and a valley enhancer. The peak detector has a peak magnitude threshold and detects harmonic amplitude control signals which have a magnitude greater then the peak magnitude threshold. The peak enhancer generates peak enhanced harmonic amplitude control signals by enhancing magnitudes of harmonic amplitude control signals which have magnitudes greater then the peak magnitude threshold. The valley detector has a minimum magnitude threshold and detects peak enhanced harmonic amplitude control signals which have a magnitude less then the minimum magnitude threshold. The valley enhancer generates enhanced harmonic amplitude control signals by decreasing the magnitudes of the peak enhanced harmonic amplitude control signals which have magnitudes less then the minimum magnitude threshold.

Briefly, according to a fourth aspect of the invention an MBE synthesizer generates a segment of speech from compressed speech data which is received by a receiver which is coupled to the MBE synthesizer. The compressed speech data received includes one or more indexes. The MBE synthesizer includes a memory, a harmonic amplitude estimator, a multi-band voicing controller, a multi-band excitation generator and a multiplier. The memory stores a table of predetermined spectral vectors identified by indexes, at least a portion of the table of the predetermined spectral vectors is associated with predetermined voicing vectors. The predetermined voicing vectors have a plurality of voicing parameters associated with a plurality of bands of spectral information. The voicing parameters identify the likelihood of a band of a bands being voiced or unvoiced. The harmonic amplitude estimator is responsive to one or more predetermined spectral vectors identified by the one or more indexes for to generate harmonic amplitudes coefficients. The multi-band voicing controller is responsive to the predetermined voicing vector and to the harmonic amplitudes coefficients and controls the voiced/unvoiced characteristics of each of the bands of spectral information. The multi-band excitation generator generates excitation components which are divided into a plurality of bands of spectral information. The multiplier is coupled to the harmonic amplitude estimator and to the multi-band voicing controller and controls the amplitudes of the excitation components by multiplying the harmonic amplitude coefficients and the excitation components to generate a spectral components representing a segment of speech.

DESCRIPTION OF A PREFERRED EMBODIMENT

Figure 1:
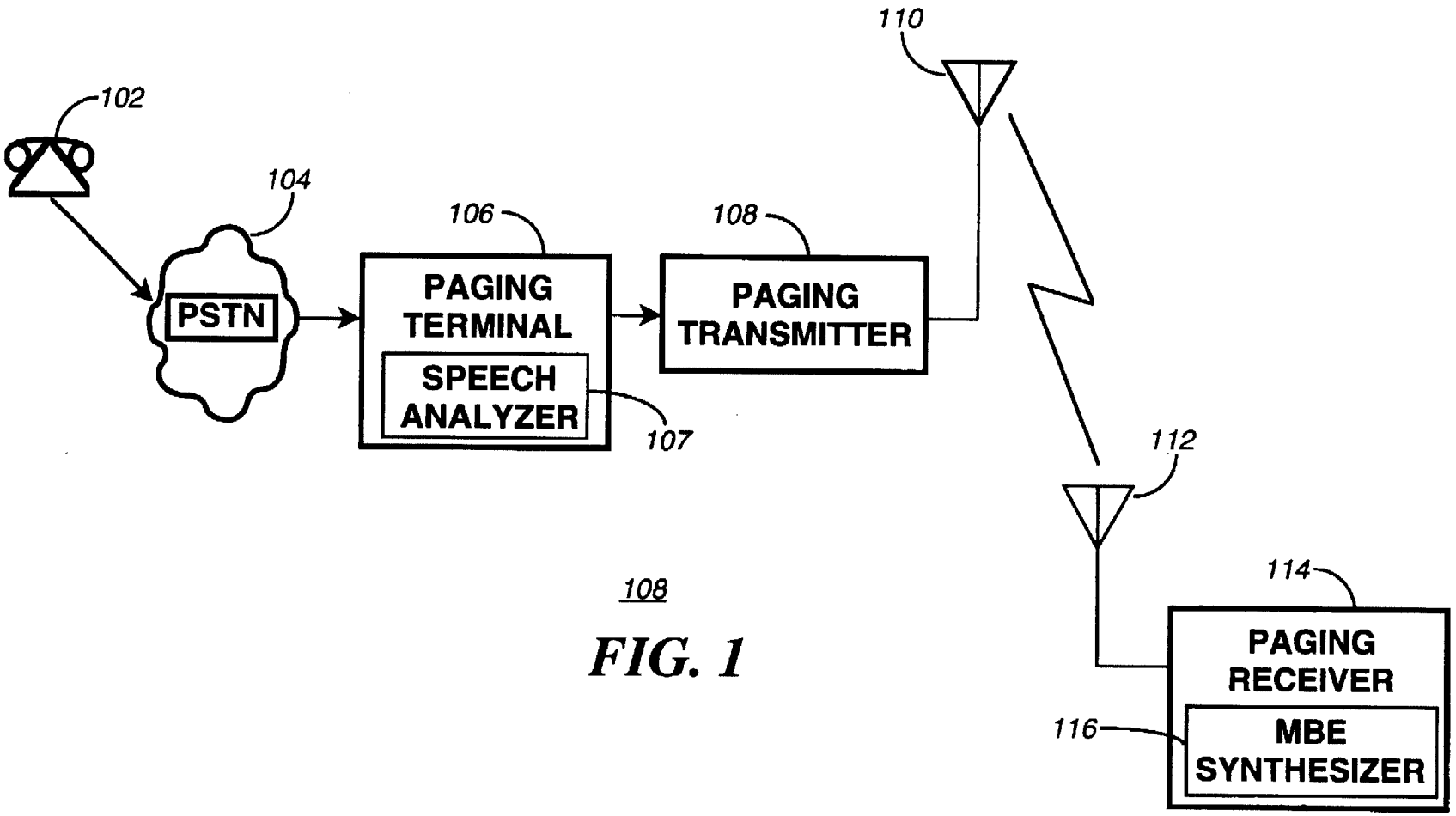
FIG. 1 is a block diagram of a very low bit rate voice messaging system using an improved MBE synthesizer in accordance with the present invention.

FIG. 1 shows a block diagram of a very low bit rate voice messaging system, such as provided in a paging or data transmission system which utilizes speech compression to provide a very low bit rate speech transmission using an improved Multi Band Exciter (MBE) voice coder (vocoder) in accordance with the present invention. As will be described in detail below, a paging terminal 106 uses an unique speech analyzer 107 to generate excitation parameters and spectral parameters representing speech data, and the communication receiver, such as a paging receiver 114 uses a unique MBE synthesizer 116 to reproduce the original speech.

By way of example, a paging system will be utilized to describe the present invention, although it will be appreciated that any non-real time communication system will benefit from the present invention as well. A paging system is designed to provide service to a variety of users, each requiring different services. Some of the users may require numeric messaging services, other users alpha-numeric messaging services, and still other users may require voice messaging services. In a paging system, the caller originates a page by communicating with a paging terminal 106 via a telephone 102 through a public switched telephone network (PSTN) 104. The paging terminal 106 prompts the caller for the recipient's identification, and a message to be sent. Upon receiving the required information, the paging terminal 106 returns a prompt indicating that the message has been received by the paging terminal 106. The paging terminal 106 encodes the message and places the encoded message into a transmission queue. In the case of a voice message, the paging terminal 106 compresses and encodes the message using a speech analyzer 107. At an appropriate time, the message is transmitted using a transmitter 108 and transmitting antenna 110. It will be appreciated that a simulcast transmission system, utilizing a multiplicity of transmitters covering different geographic areas can be utilized as well.

The signal transmitted from the transmitting antenna 110 is intercepted by a receiving antenna 112 and processed by a receiver 114, shown in FIG. 1 as a paging receiver. Voice messages received are decoded and reconstructed using an MBE synthesizer 116. The person being paged is alerted and the message is displayed or annunciated depending on the type of messaging being received.

The digital voice encoding and decoding process used by the speech analyzer 107 and the MBE synthesizer 116, described herein, is readily adapted to the non-real time nature of paging and any non-real time communication system. These non-real time communication systems provide the time required to perform a highly computational compression process on the voice message. Delays of up to two minutes can be reasonably tolerated in paging systems, whereas delays of two seconds are unacceptable in real time communication systems. The asymmetric nature of the digital voice compression process described herein minimizes the processing required to be performed at the receiver 114, making the process ideal for paging applications and other similar non-real time voice communications. The highly computational portion of the digital voice compression process is performed in the fixed portion of the system, i.e. at the paging terminal 106. Such operation, together with the use of an MBE synthesizer 116 that operates almost entirely in the frequency domain, greatly reduces the computation required to be performed in the portable portion of the communication system.

The speech analyzer 107 analyzes the voice message and generates spectral parameters and excitation parameters. The spectral parameters are generated by first performing a fixed dimension LPC analysis. The LPC analysis generates ten spectral parameters. Two spectral code books are used to vector quantize the ten spectral parameters into two 11 bits indexes for transmission by the paging terminal 106. The speech analyzer 107 does not generate harmonic phase information as in prior art analyzers, but instead a unique frequency domain technique, described below, is used by the MBE synthesizer 116 to artificially regenerate phase information at the receiver 114. This unique technique eliminates the need to transmit additional data to convey the phase information.

The excitation parameters generated by the speech analyzer 107 to define a segment of speech preferably include a seven bit pitch parameter, a six bit RMS parameter, and an one bit frame voiced/unvoiced parameter. Multi-band voicing information is not generated as in the prior art speech analyzers.

The pitch parameter defines the fundamental frequency of the repetitive portion of speech. Pitch is measured in vocoders as the period of the fundamental frequency.

The frame voiced/unvoiced parameter describes the repetitive nature of the sound. Segments of speech that have a highly repetitive waveform are described as voiced, whereas segments of speech that have a random waveform are described as being unvoiced. The frame voiced/unvoiced parameter generated by the speech analyzer 107 determines whether the MBE synthesizer 116 uses a periodic signal as an excitation source or a noise like signal source as an excitation source. Frames of speech that are classified as voiced often have spectral portions that are unvoiced. The speech analyzer 107 and MBE synthesizer 116 produces excellent quality speech by dividing the voice spectrum into a number of sub-bands and including information describing the voiced/unvoiced nature of the voice signal in each sub-band. The sub-band voice/unvoiced parameters, in conventional synthesizers, must be degenerated by the speech analyzer 107 and transmitted to the MBE synthesizer 116. In the present invention, the voicing information for each sub-band is not transmitted by the paging terminal 106, but a relationship between the sub-band voiced/unvoiced information and the spectral information is established. A ten band voicing code book containing the voiced/unvoiced likelihood parameter is associated with a spectral code book. The index of the ten band voicing code book is the same as the index of the spectral code book, thus only a common index need be transmitted. The present invention uses voicing parameters stored in the voicing code book to generate the ten sub-band voicing information thus eliminating the need to transmit this information as would be required by a convention MBE synthesizer.

The RMS parameter is a measurement of the total energy of all the harmonics in a frame. The RMS parameter is generated by the speech analyzer 107 and is used by the MBE synthesizer 116 to establish the volume of the reproduced speech.

Figure 2:
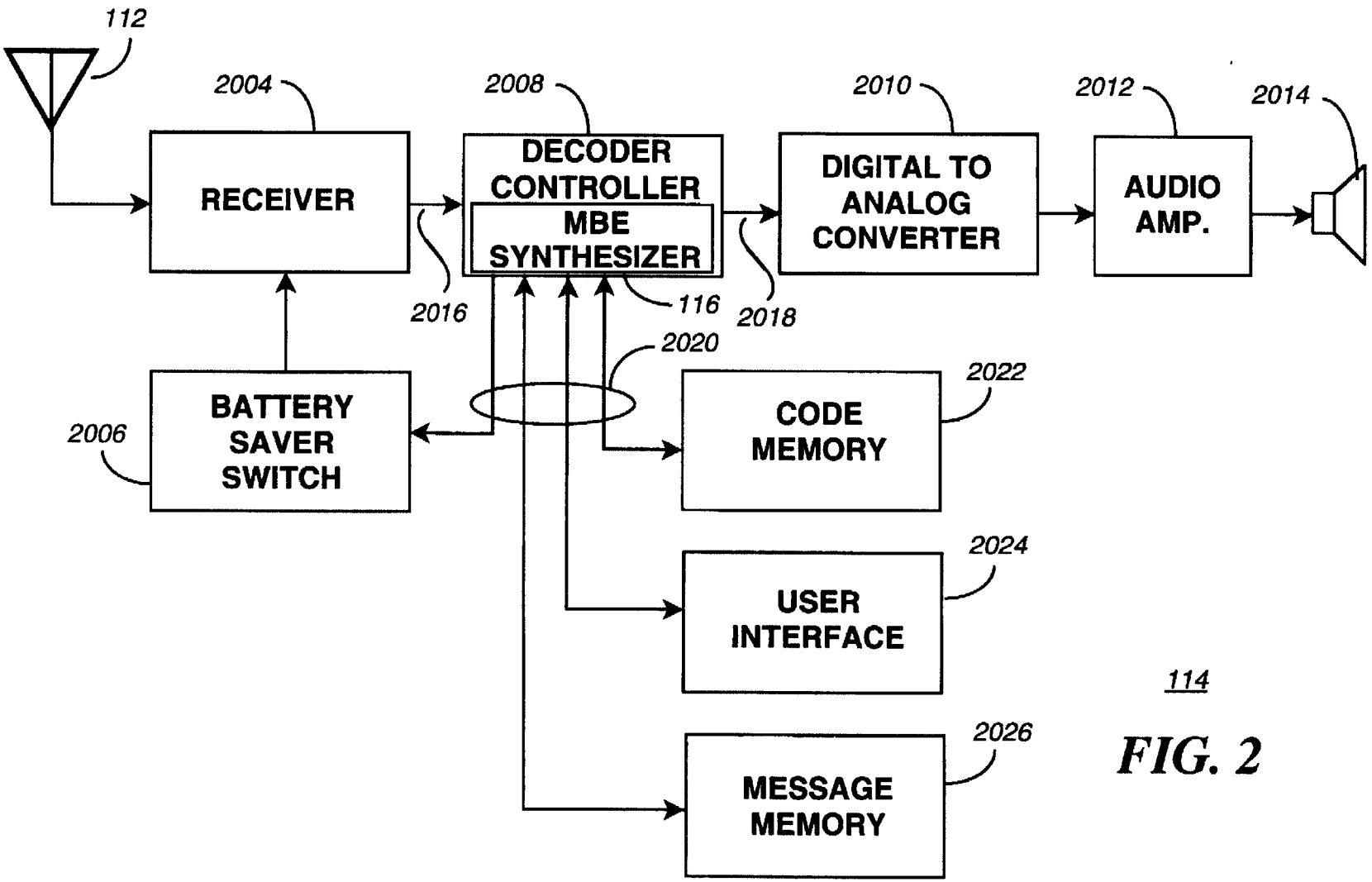
FIG. 2 is an electrical block diagram of the receiver shown in FIG. 1.

FIG. 2 is an electrical block diagram of the receiver 114 of FIG. 1, such as a paging receiver or data communication receiver. The signal transmitted from the transmitting antenna 110 is intercepted by the receiving antenna 112 which is coupled to a receiver 2004. The receiver 2004 processes the signal received by the receiving antenna 112 and produces a receiver output signal 2016 which is a replica of the encoded data transmitted. The encoded data is encoded in a predetermined signaling protocol. One such encoding method is the InFLEXion® protocol, developed by Motorola Inc. of Schaumburg, Ill., although it will be appreciated that there are other suitable encoding methods that can be utilized as well, for example, the Post Office Code Standards Advisory Group (POCSAG) code. A digital signal processor 2008 performing the function of a decoder, controller and MBE synthesizer 116 processes the receiver output signal 2016 and produces a decompressed digital speech data 2018 as will be described below. A digital to analog converter converts the decompressed digital speech data 2018 to an analog signal that is amplified by the audio amplifier 2012 and annunciated by a speaker 2014.

The digital signal processor 2008 also provides the basic control of the various functions of the receiver 114. The digital signal processor 2008 is coupled to a battery saver switch 2006, a code memory 2022, a user interface 2024, and a message memory 2026, via the control bus 2020. The code memory 2022 stores unique identification information or address information, necessary for the controller to implement the selective call feature. The user interface 2024 provides the user with an audio, visual or mechanical signal indicating the reception of a message and can also include a display and push buttons for the user to input commands to control the receiver. The message memory 2026 provides a place to store messages for future review, or to allow the user to repeat the message. The battery saver switch 2006 provide a means of selectively disabling the supply of power to the receiver during a period when the system is communicating with other pagers or not transmitting, thereby reducing power consumption and extending battery life in a manner well known to one ordinarily skill in the art.

Figure 3:
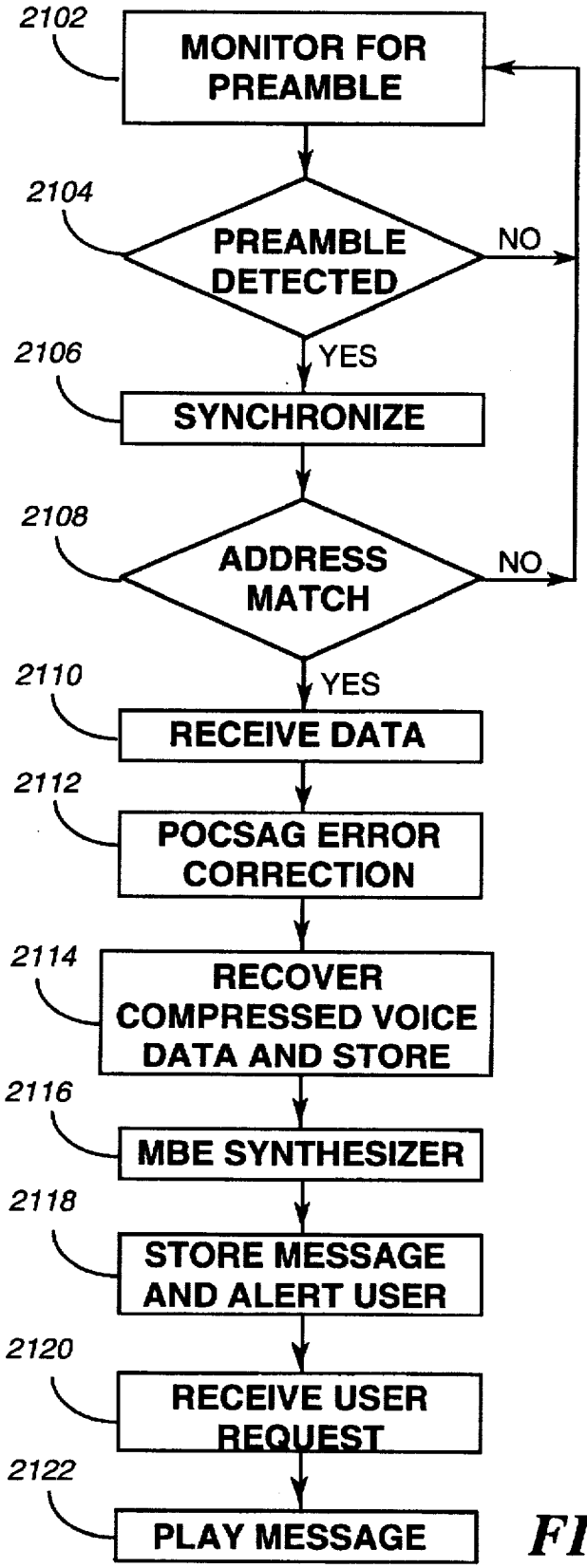
FIG. 3 is a flow chart which illustrates the operation of the receiver of FIG. 2.

FIG. 3 is a flow chart which illustrates the operation of the receiver 114 of FIG. 2. In step 2102, the digital signal processor 2008 sends a command to the battery saver switch 2006 to supply power to the receiver 2004. The digital signal processor 2008 monitors the receiver output signal 2016 for a bit pattern indicating that the paging terminal is transmitting a signal modulated with a preamble.

At step 2104, a decision is made as to the presence of the preamble. When no preamble is detected, then the digital signal processor 2008 sends a command to the battery saver switch 2006 to inhibit the supply of power to the receiver 2004 for a predetermined length of time. After the predetermined length of time, at step 2102, monitoring for preamble is again repeated as is well known in the art. In step 2104, when a preamble is detected, the digital signal processor 2008 will synchronize at step 2106 with the receiver output signal.

When synchronization is achieved, the digital signal processor 2008 may issue a command to the battery saver switch 2006 to disable the supply of power to the receiver 2004 until the frame assigned to the receiver 114 is expected. At the assigned frame, the digital signal processor 2008 sends a command to the battery saver switch 2006 to supply power to the receiver 2004. In step 2108, the digital signal processor 2008 monitors the receiver output signal 2016 for an address that matches the address assigned to the receiver 114. When no match is found the digital signal processor 2008 sends a command to the battery saver switch 2006 to inhibit the supply of power to the receiver until the next transmission of a synchronization code word or the next assigned frame, after which step 2102 is repeated. When an address match is found then in step 2108, power is maintained to the receiver 2004 and the data is received at step 2110.

In step 2112, error correction is performed on the data received in step 2110 to improve the quality of the voice reproduced. The encoded frame provides nine parity bits which are used in the error correction process. Error correction techniques are well known to one of ordinary skill in the art. The corrected data is stored in step 2114. The stored data is processed in step 2116. The processing of digital voice data de-quantizes and enhances the spectral information, combines the spectral information with the excitation information, artificially generates phase information and synthesizes the voice data as will be described below.

In step 2118, the digital signal processor 2008 stores the voice data, received in the message memory 2026 and sends a command to the user interface 2024 to alert the user. In step 2120, the user enters a command to play out the message. In step 2122, the digital signal processor 2008 responds by passing the decompressed voice data that is stored in message memory to the digital to analog converter 2010. The digital to analog converter 2010 converts the digital speech data 2018 to an analog signal that is amplified by the audio amplifier 2012 and annunciated by speaker 2014.

Figure 4:
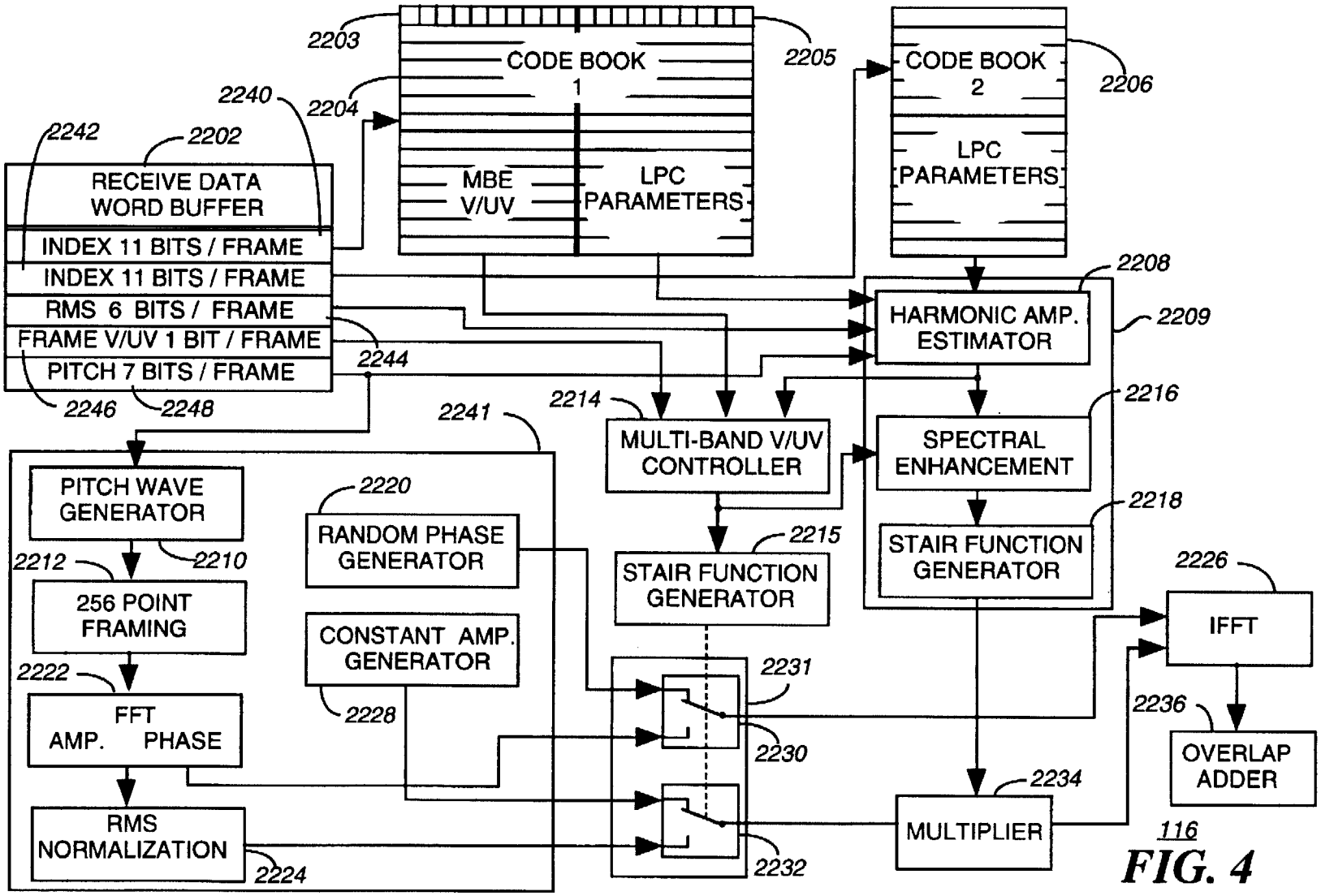
FIG. 4 is an block diagram showing the improved MBE synthesizer in accordance with the present invention.

FIG. 4 is a block diagram of the improved MBE synthesizer 116 shown in FIG. 2 and at step 2116 in FIG. 3. The MBE synthesizer 116 generates segments of speech from compressed speech data which are received by receiver 114 as preferably a thirty-six bit data word and stored in a buffer 2202. The buffer 2202 is also referred to herein as an input buffer 2202. The input buffer 2202 preferably stores a minimum of two thirty-six bit data words representing at least two sequential segments of speech. The thirty-six bit data words stored in the buffer 2202 and decoded in step 2114 comprises one or more indexes, a first eleven bit index 2240, a second eleven bit index 2242, a six bit RMS data 2244, a one bit of frame voicing data 2246 and seven bits of pitch data 2248.

The first eleven bit index 2240 is coupled to a co-indexed code book 2204 to provide a first index. The second eleven bit index 2242 is coupled to code book two 2206 to provide a second index. The co-indexed code book 2204 stores a first table of predetermined spectral vectors 2205 and the code book 2206 stores a second table of predetermined residue vectors. Each predetermined spectral vectors 2205 comprises a plurality of spectral parameters. The co-indexed code book 2204 also stores a table of associated predetermined voicing vectors 2203. Each predetermined voicing vector comprises a plurality of voicing parameters. Each of the voicing parameters is associated with a band of excitation components. Two LPC parameters from the co-indexed code book 2204 indexed by the first eleven bit index 2240 and the residue LPC parameters from code book two 2206 indexed by the second eleven bit index 2242 are coupled to a harmonic amplitude estimator 2208, a part of an improved harmonic amplitude estimator 2209. The six bit RMS data 2244 is also coupled to the harmonic amplitude estimator 2208. The improved harmonic amplitude estimator 2209 comprises a harmonic amplitude estimator 2208, a spectral enhancer 2216 and a stair function generator 2218.

The output of the harmonic amplitude estimator 2208 is coupled to a multi-band voicing controller 2214. The one bit of frame voicing data 2246 and the data from the MBE voicing portion of the co-indexed code book 2204 is also coupled to the multi-band voicing controller 2214. The output of the harmonic amplitude estimator 2208 is also coupled to a spectral enhancer 2216 which provides a spectral enhancement function. The output of the spectral enhancer 2216 is coupled to a stair function generator 2218 which in turn is coupled to a multiplier 2234.

An excitation generator 2241 generates transformed voiced excitation components and transformed unvoiced excitation components utilizing a transform function. The excitation generator 2241 comprises a pitch wave generator 2210, a 256 point framer 2212, a FFT transform generator 2222, a RMS normalization 2224, a random phase generator 2220, and a constant amplitude generator 2228. The seven bits of pitch data 2248 is coupled to a pitch wave generator 2210. The output of the pitch wave generator 2210 is coupled to a 256 point framer 2212 and the output of the 256 point framer 2212 is coupled to a FFT transform generator 2222. A phase output of the FFT transform generator 2222 is coupled to the spectral phase selector 2230. The output of a random phase generator 2220 is also coupled to the spectral phase selector 2230. An amplitude output of the FFT transform generator 2222 is coupled to a RMS normalization 2224 which is in turn coupled to a spectral amplitude selector 2232. The output of a constant amplitude generator 2228 is also coupled to the spectral amplitude selector 2232. The multi-band voicing controller 2214 is coupled to a stair function generator 2215 which in turn is coupled to and controls the spectral phase selector 2230 and the spectral amplitude selector 2232. The spectral phase selector 2230 and the spectral amplitude selector 2232 are also referred to herein as a selector 2231.

The output of the spectral phase selector 2230 is coupled to an IFFT inverse transform generator 2226. The output of the spectral amplitude selector 2232 is coupled to the multiplier 2234. The multiplier 2234 is also coupled the harmonic amplitude estimator for generating spectral amplitude components which in turn are coupled to the IFFT inverse transform generator 2226. The output of the IFFT inverse transform generator 2226 is coupled to an overlap adder 2236 which produces digitized samples of the original speech message.

The harmonic amplitude estimator 2208 is coupled to the LPC parameters in a predetermined spectral vector 2205 stored in the voicing portion of the co-indexed code book 2204, in a spectral vector stored in the code book two 2206, and the seven bits of pitch data 2248 from the thirty-six bit data word stored in the buffer 2202 to generate a variable length harmonic amplitude function S(i). The speech spectral amplitude information is conveyed by the two eleven bit indexes which are received and which are part of the thirty-six bit data word stored in the buffer 2202. The first eleven bit index 2240 points to a first predetermined spectral vector of the table of predetermined spectral vectors 2205 stored in the voicing portion of the co-indexed code book 2204. The table of predetermined spectral vectors 2205 stored in the voicing portion of the co-indexed code book 2204 is a duplicate of the table of predetermined spectral vectors, which comprise a spectral code book used by the paging terminal 106 during the speech compression process. The first spectral vector contains a first set of LPC parameters. The second eleven bit index 2242 points to a second predetermined spectral vector of a second table of predetermined residue vectors stored in the code book 2206. The second residue vector contains a second set of residue LPC parameters. The first set of LPC parameters is added to the second set of LPC parameters to produce a set of LPC parameters that are used to determine the amplitude of the spectral component produced by the excitation generator 2241.

The length of the variable length harmonic amplitude function, S(i) is determined by the seven bits of pitch data 2248. The variable length function S(i) has one spectral gain parameter for each harmonic of the pitch signal. The generation of the pitch signal is described below. In the preferred embodiment of the present invention, the number of harmonics in the pitch signal is a function of the pitch and is calculated using the following formula.

$$N = (INT)\frac{.9375*\text{Pitch}}{2}$$

Where;

INT is a function that returns a integer value and

N equals the number of harmonics.

The function S(i) is multiplied by a value derived from the value of the six bit RMS code received as part of the thirty-six bit data word stored in the buffer 2202. The RMS code sets the volume of the segment of speech being reproduced The determination of the function S(i) from the LPC parameters by the harmonic amplitude estimator 2208 will be described below.

The parameters of the function S(i), generated, by the harmonic amplitude estimator 2208, are analyzed and adjusted by a spectral enhancer 2216. The spectral enhancement function of the spectral enhancer 2216 compensates for the under estimation of the harmonic amplitude by harmonic amplitude estimator 2208 and for the spectral distortion generated by noise. The spectral enhancement function 2216 generates the enhanced function S"(i). It will be appreciated by one skilled in the art that the spectral information can also be pre-enhanced at the paging terminal 106 prior to transmission. The operation of the spectral enhancement function is described below.

A stair function generator 2218 transforms the variable length function S"(i) into a fixed length function of 128 points. The function S"(i) has one spectral gain parameter for each harmonic of the fundamental frequency of the pitch signal. The 128 points are divided up into a number of bands, one band for each harmonic, with each band centered about each harmonic. The value of all the points of the function that fall into each band is set equal to the corresponding spectral gain parameter. The resulting spectral gain factor function has a stair step appearance.

Figure 5:
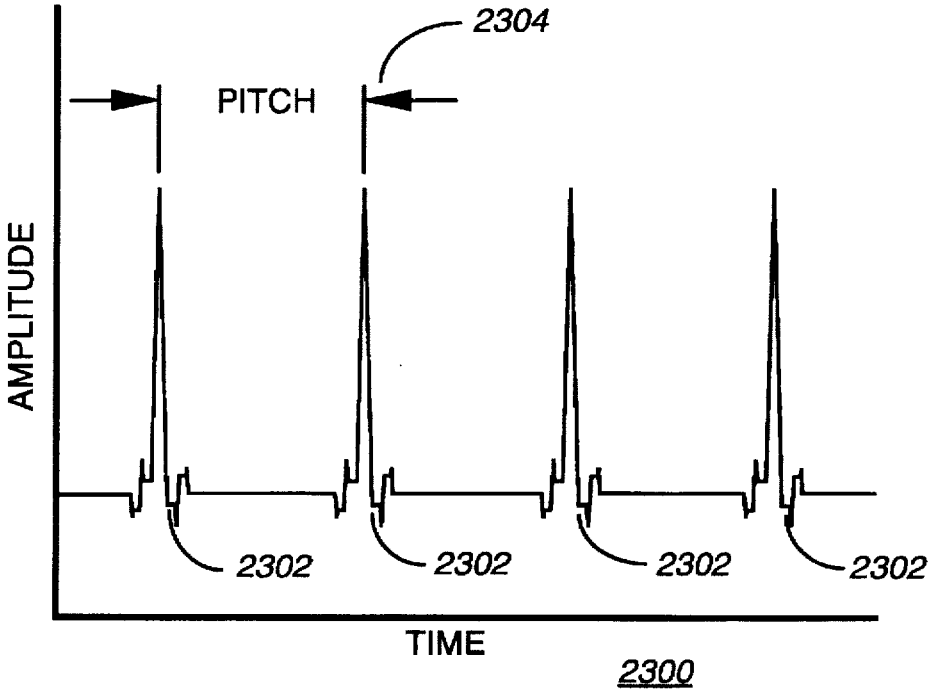
FIG. 5 shows the waveform of a typical pitch signal generated by the pitch generator shown in FIG. 4.

A pitch wave generator 2210 produces the basic synchronous pitch signal, responsive to the seven bits of pitch data 2248 that was received and stored in the thirty-six bit data word buffer 2202. The synchronous pitch signal is used by the MBE synthesizer 116 to reproduce the original speech. The pitch is defined as the number of samples between the repetitive portions of the pitch signal. In the preferred embodiment of the present invention, the pitch signal has the range of 20 to 128. Also in the preferred embodiment of the present invention a value of one is subtracted from the pitch data prior to transmission such that the pitch can be encoded using seven bits. A value of one must be added back at the receiver by the digital signal processor 2008 to correct for the value of one subtracted at the transmitter. FIG. 5 shows, by way of example, the wave from of a typical pitch signal. The wave form is a sequence of replicated, pre-defined pulses 2302 of a fixed duration with variable pitch distance 2304 between start of the pulses. The distance between the predefined pulses 2302 in the first half of the frame is continuously interpolated between the ending distance of the previous frame and the distance defined by the current seven bits of pitch data 2248 received. The distance in the last half of the frame is continuously interpolated between the distance defined by the current seven bits of pitch data 2248 received and the distance defined by the seven bits of pitch data 2248 received for the subsequent frame. The interpolation produces a pitch signal that smoothly follows the changes in the pitch data. In the preferred embodiment of the present invention, the pre-defined pulses 2302 are stored as a table of values in the MBE synthesizer 116.

Two hundred fifty six points of the pitch signal are framed by the 256 point framer 2212 to produce a windowed sequence of repetitive digitized pitch samples of a predetermined length. An FFT is performed on the 256 sample frame to produce 128 point Fourier amplitude function containing discrete Fourier voiced amplitude components and a 128 point Fourier phase function containing discrete Fourier voiced phase components. No phase information is transmitted in the present invention, and therefor the phase information is regenerated by the FFT transform generator 2222 calculation of the FFT spectrum of the pitch signal 2300 is used to derive phase information. This artificially generated phase information produces natural sounding speech without the burden of transmitting the large quantity of information necessary to convey the phase information, as in the prior art MBE synthesizers.

Each pre-defined pulses 2302, has a fixed duration and amplitude, resulting in a fixed amount of energy, and therefor the power of the pitch signal is a function of the number of pre-defined pulses 2302 in each frame. Frames having fewer pitch pulses therefor have less power than frames having more pitch pulses. The RMS normalization 2224 normalizes Fourier amplitude function to maintain the total energy at a predetermined energy level for pitch signals of all frames. The normalized Fourier amplitude function and Fourier phase function as used as an excitation source for the MBE synthesizer during voiced periods to reproduce the original speech.

During unvoiced periods, the constant amplitude generator 2228 produces discrete Fourier unvoiced amplitude components of a constant amplitude and the random phase generator 2220 produces discrete Fourier unvoiced phase components.

The one bit of frame voicing data 2246 is use by the multi-band voicing controller 2214 along with ten band predetermined voicing vector 2203, P, that is stored in a MBE voicing portion of the co-indexed code book 2204 and spectral gain parameters in the function S(i) to determine the voiced/unvoiced characteristics of the speech being reproduced. The first eleven bit index 2240, points to the first predetermined spectral vector of the table of predetermined spectral vectors 2225 stored in the co-indexed code book 2204 is also used to index a ten band predetermined voicing vector 2203, P, stored in the MBE voicing portion of the co-indexed code book 2204. The operation of the multi-band voicing controller 2214 is described below.

The multi-band voicing controller 2214 produces a variable length binary function h(i). The stair function generator 2215 transforms the variable length binary function h(i) into a fixed length binary function of 128 points. The function h(i) has a one bit binary parameter for each of the harmonics of the fundamental frequency of the pitch signal. The 128 points of the fixed length function are divided up into a number of bands, one band for each harmonic, with each band centered about the harmonic. The value of all the points of the fixed length function that fall into each band is set equal to the corresponding binary voicing parameter. The output of the stair function generator 2215 is coupled to the spectral phase selector 2230 and the spectral amplitude selector 2232 to enable the multi-band voicing controller 2214 to control a selection of phase excitation components from the discrete Fourier voiced phase components and from the discrete Fourier unvoiced phase components, and to further controls a selection of amplitude excitation components from the discrete Fourier voiced amplitude components and from the discrete Fourier unvoiced amplitude components.

When the output of the multi-band voicing controller 2214 is set to a value of 1, indicating a voiced period, the spectral phase selector 2230 selects the Fourier phase function from the FFT transform generator 2222 and the spectral amplitude selector 2232 selects the Fourier amplitude function from the FFT transform generator 2222. When the output of the multi-band voicing controller 2214 is set to a value of 0 the spectral phase selector 2230 selects the phase information from the random phase generator 2220 and the spectral amplitude selector 2232 selects the Fourier amplitude function from the constant amplitude generator 2228.

The FFT amplitude function from the spectral amplitude selector 2232 is coupled to the multiplier 2234. The multiplier 2234 multiplies the Fourier amplitude function from the spectral amplitude selector 2232 by harmonic amplitude control signals defined in the spectral gain factor function generated by the stair function generator 2218 to produce a Fourier function containing the spectral amplitude information.

The phase information from the spectral phase selector 2230 and the Fourier function from the multiplier 2234 are coupled to the IFFT inverse transform generator 2226. The IFFT inverse transform generator 2226 performs a Inverse Fourier Transform (IFFT) to produce a time domain function. The time domain function is overlapped by the past and future frame in the overlap adder 2236 to generate a pulse amplitude coded representation of the original speech. The sampled speech segments are extended such that all segments overlap the previous and future segments by fifty percent. An overlap adder function 2236 tends to smooth the transition between speech segments. The operation of the overlap adder function 2236 is well known to one of ordinary skill in the art.

Figure 6:
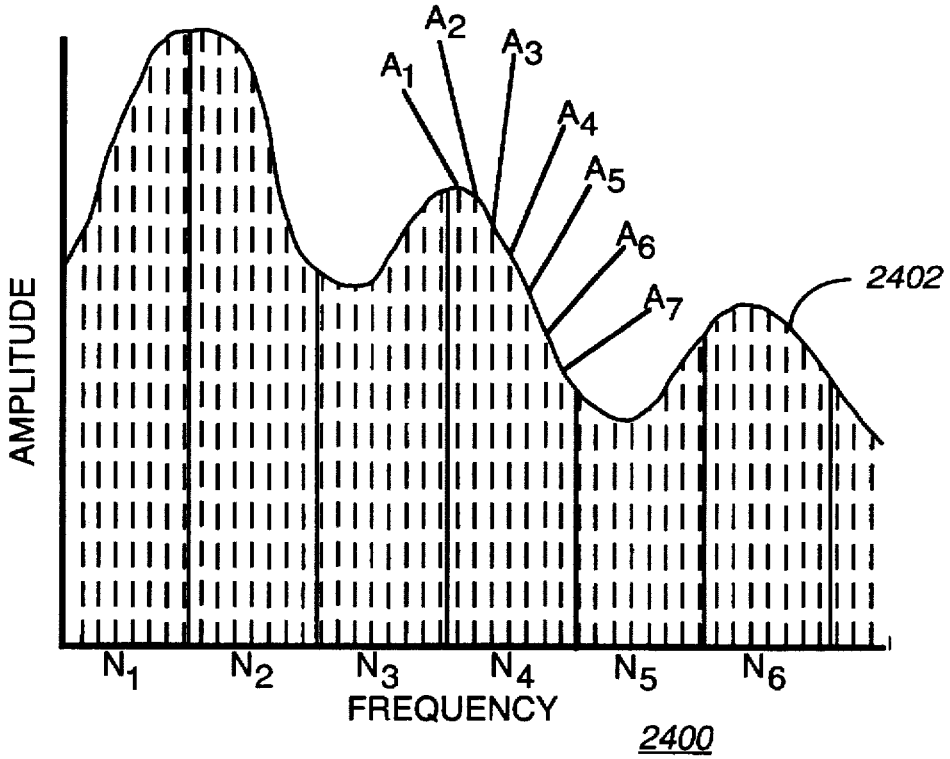
FIG. 6 is a graphic illustration of a portion of a typical LPC function analyzed by the harmonic amplitude estimator shown in FIG. 4.

FIG. 6 shows, by way of example, a graphic illustration of a portion of a typical LPC function analyzed by the harmonic amplitude estimator 2208 shown in FIG. 4. The LPC parameters resulting from the addition of the first set of LPC parameters from the co-indexed code book 2204 and the second set of LPC parameters from the code book two 2206 have ten coefficients. The ten coefficients are coefficients of a polynomial that define a continuous LPC function 2402. The value of the continuous LPC function 2402 is calculated at two hundred fifty six points. The two hundred fifty six points are divided into a number of bands, with the number of bands equal to the number of harmonics. The number of harmonics being a function of pitch as described above. The first six harmonic bands, $N_1$ through $N_6$ are shown by way of example in FIG. 6. In this example the harmonic band $N_4$ has seven, $A_1$ through $A_7$ of the two hundred fifty six points of the continuous LPC function 2402. The harmonic amplitude estimate is defined by the following equation.

$$H_i=\sqrt{\frac{A_1^2+A_2^2+A_3^2+\ldots A_j^2}{j}}$$

Where;

$H_i$ equals the amplitude of harmonic i i equals the harmonic band, j equals the number of the 256 points that fall band i.

The function $H_i$ is multiplied by a value derived from the value of the six bit RMS data 2244 received as part of the thirty-six bit data word stored in the buffer 2202 to produce S(i). The function S(i) is a discrete function comprising a harmonic amplitude control signal for each harmonic of the pitch signal.

Figure 7:
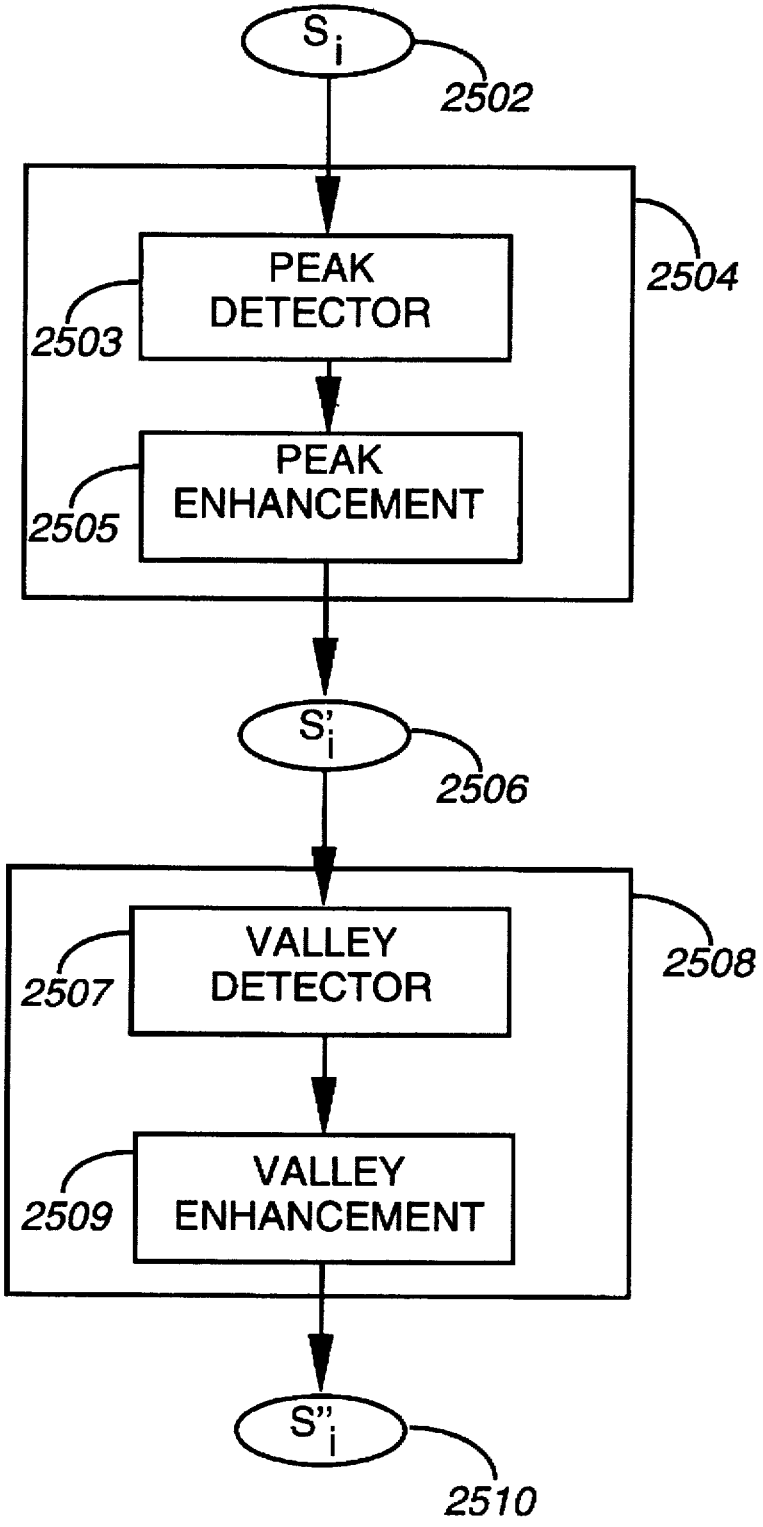
FIG. 7 is a flow chart illustrating spectral enhancement within the improved MBE synthesizer of FIG. 4.

FIG. 7 is a flow chart illustrating the spectral enhancement function within the improved MBE synthesizer of FIG. 4. The spectral enhancement function performed by the spectral enhancer 2216 is a two step process. The spectral gain parameters generated by the harmonic amplitude estimator 2208 are a variable length function S(i) 2502. The function S(i) 2502 has one parameter for each harmonic amplitude estimated above. The parameters are also referred to herein as harmonic amplitude control signals. At step 2504 a peak detector 2503 is provided for detecting harmonic amplitude control signals having a magnitude greater then a peak magnitude threshold and a peak enhancer 2505 is provided for generating peak enhanced harmonic amplitude control signals by enhancing magnitudes of harmonic amplitude control signals having magnitudes greater then the peak magnitude threshold. The levels of the harmonics that occur at the peaks of the function S(i) 2502 are increased, generating function S'(i) 2506. Then at step 2508, a valley detector 2507 is provided for detecting peak enhanced harmonic amplitude control signals having a magnitude less then a minimum magnitude threshold, and a valley enhancer 2509 is provided for generating enhanced harmonic amplitude control signals by decreasing the magnitudes of the peak enhanced harmonic amplitude control signals having magnitudes less then the minimum magnitude threshold. The level of the harmonics that occur at the valleys of the function S'(i) 2506 are reduced, generating the function S"(i) 2510.

Figure 8:
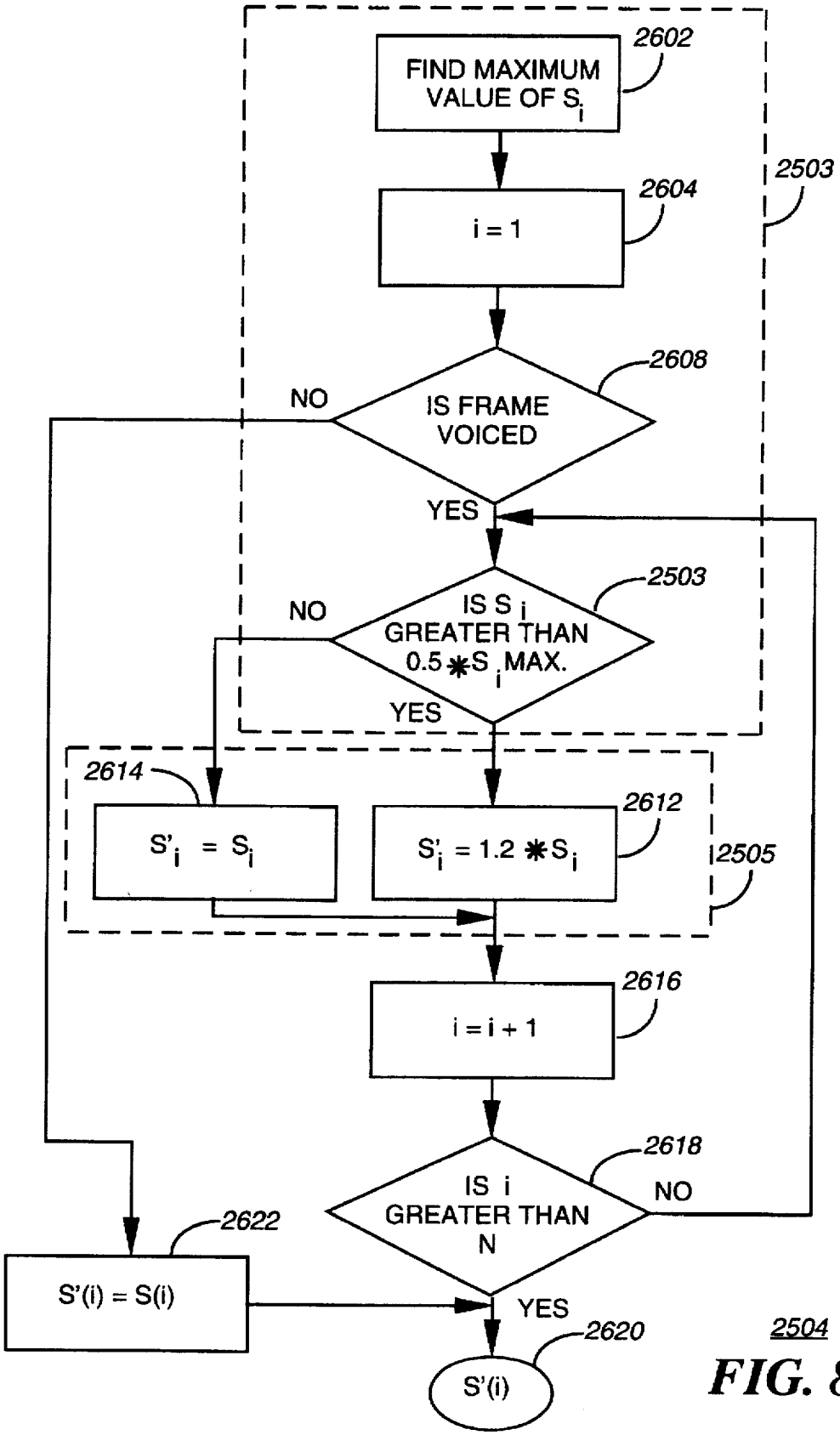
FIG. 8 is a flow chart describing the peak enhancement process shown in FIG. 7.

FIG. 8 is a flow chart of the peak enhancement process of step 2504 of FIG. 7. The steps of the flow chart associated with the peak detector 2503 and the peak enhancer 2505 are enclosed with a dotted line. The peak enhancement process starts at step 2602 where a search is made of the function S(i) for the parameter $S_i$ having a maximum amplitude, $S_i$ Max. Next at step 2604 the variable i is set equal to 1.

Then at step 2608 a test is made to determine if the frame is voiced or unvoiced by checking the frame voiced/unvoiced bit, which is part of the thirty-six bit data word stored in the buffer 2202. When the frame is unvoiced the process goes to step 2622 where S'(i) is set equal to S(i) and then at step 2620 S'(i) is returned.

When at step 2608 the frame is determined to be voiced, then at step 2610 a test is made to determine if the value of $S_i$ is greater than a predetermined proportion of $S_i$ Max, where the predetermined proportion is preferably 0.5. When $S_i$ is greater than $0.5*S_i$ Max then at step 2612 the value of $S'_i$ is multiplied by a predetermined number, where the predetermined number is preferably 1.2. When $S_i$ is not greater than $0.5*S_i$ Max then at step 2614 the value of $S'_i$ is set equal to $S_i$.

Next at step 2616 the value of i is incremented by 1. Then at step 2618 a test is made to determine if the value i is greater than the number N of parameters in S(i). When the value of i is not greater than N the process goes to step 2610 where this process is repeated on the next parameter. When the value of i is not greater than N, then at step 2612 S'(i) is returned.

It will be appreciated that although only one threshold is shown at step 2610 and only one correction factor is shown at step 2612, more then one threshold and corresponding correction factor can be provided as well.

Figure 9:
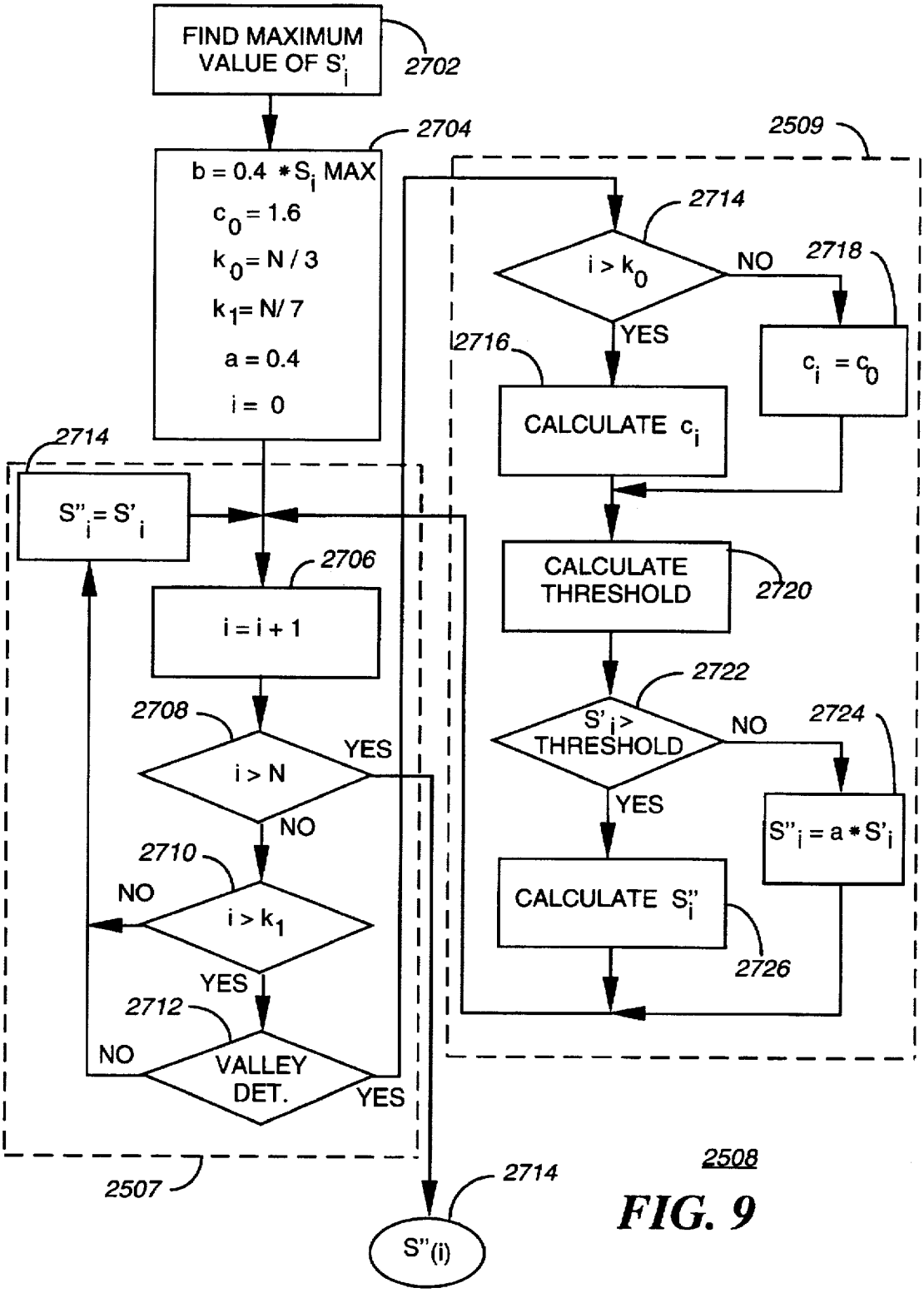
FIG. 9 is a flow chart describing the valley enhancement process shown in FIG. 7.

FIG. 9 is a flow chart showing the valley enhancement process of step 2508 of FIG. 7. The steps of the flow chart associated with the valley detector 2507 and the valley enhancer 2509 are enclosed with a dotted line. At step 2602 a search is made of the function S'(i) for the parameter $S'_i$ having the largest value, $S'_i$ Max. Next at step 2704 the following temporary constants are established.

$b=0.4*S_i$ Max $c_O=1.6$ $k_O=N/3$ $K_1=N/7$ a=0.4 i=0

Where;

N equals the number of parameters in S(i)

$S_i$ Max equals the largest parameter of S(i).

Next at step 2706 the value of i is incremented by a value of one. Then at step 2708 a test is made to determine if the value of i is greater then N. When the value of i is greater than N the process is complete and the value of S"(i) is returned at step 2714. When the value of i is not greater than N the process continues at step 2710.

At step 2710 a test is made to determine if the value of i is greater then the constant $k_1$. When the value of i is not grater than $k_1$ no enhancement is made and the process goes to step 2714 where the value of $S''_i$ is set equal to $S'_i$, followed by step 2706 where i is incremented by a value of one in preparation to examine the next i. When the value of i is grater than $k_1$, a test is made at step 2712 to determine if the parameter is in a valley. The test to determine if the parameter is in a valley is described below.

When at step 2712 it is determined that the parameter is not in a valley then no enhancement is made and the process goes to step 2714 where the value of $S''_i$ is set equal to $S'_i$, followed by step 2706 where i is incremented by a value of one in preparation to examine the next i. When at step 2712 it is determined that the parameter is in a valley the process goes to step 2714 where the enhanced valley value is determined.

At step 2714 a test is made to determine if the value of i is greater than $k_0$. When the value of i is not greater than $k_0$, the value of the variable $c_i$ is set equal to $c_0$ at step 2718. When the value of i is greater than $k_0$ the value of the variable $c_i$ is calculated by the following formulas at step 2716.

$$c_i = c_0 - \frac{(c_0 - 1)(i - k_0)}{(N - k_0 + 1)}$$

Then at step 2720 a threshold, t, is calculated using the following formula $$t = b * a^{\left(\frac{1}{c_i - 1}\right)}$$

Next at step 2722, the digital signal processor 2008 performs the function of a magnitude comparator to determine if the value of $S'_i$ is greater then threshold t. When the value of $S'_i$ is greater then threshold t, then at step 2726 the digital signal 2008 performs the function of a magnitude calculator to calculate the value of $S''_i$ using the following first predetermined formula $$S''_i = b\left(\frac{S'_i}{b}\right)^{c_i}$$

When the value of $S'_i$ is not greater then threshold t, then at step 2724, the digital signal processor 2008 performs the function of a magnitude calculator to calculate the value of $S''_i$ using the following second predetermined formula $$S'' = a * S'_i$$

Figure 10:
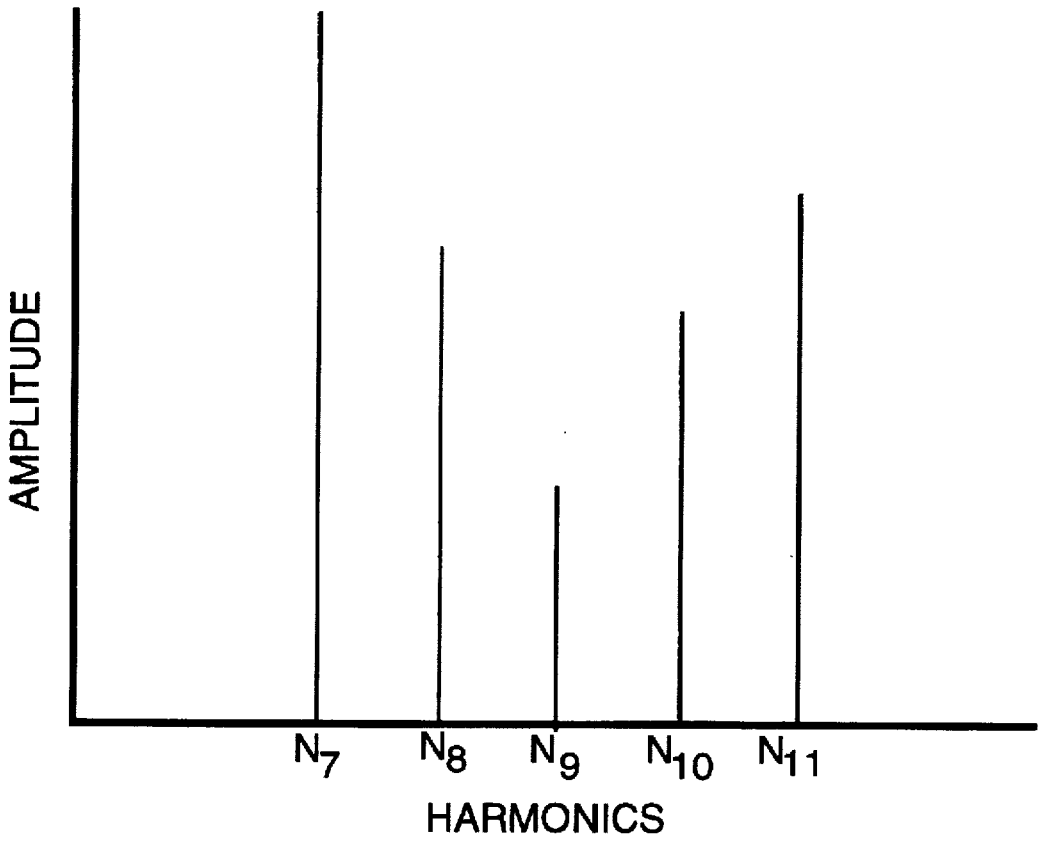
FIG. 10 is a plot of several harmonics illustrating a harmonic valley determination used in the valley enhancement process of FIG. 9.

Next at step 2706 i is incremented by a value of one in preparation to examine the next i. When at step 2708 i is less than N the process continues at step 2710. Otherwise the process is complete and S"(i) is returned. FIG. 10 is, by way of example, a plot of several typical harmonics illustrating harmonic valley determination used in the enhancement process of FIG. 9. In the preferred embodiment of the present invention, a harmonics amplitude must be less then the two adjacent harmonics by a predetermined amount to qualify as a valley. In the example illustrated in FIG. 10, five harmonics, $N_7$ through $N_{11}$ are shown. Harmonic $N_9$ has the lowest amplitude. Of the two adjacent harmonics, $N_8$, a first adjacent peak enhanced harmonic amplitude control signal, and $N_{10}$, a second adjacent peak enhanced harmonic amplitude control signal, $N_8$ has the largest amplitude. To qualify as an valley the harmonic must be less than the lesser of a first predetermined proportion, preferably 60%, of the amplitude of the highest adjacent harmonic and less than a second predetermined proportion, preferably 80%, of the opposite adjacent harmonic amplitude control signal. In this example $N_9$ must be less than 60% of the amplitude of $N_8$ and $N_9$ must be less than 80% of $N_{10}$ to qualify as an valley.

Figure 11:
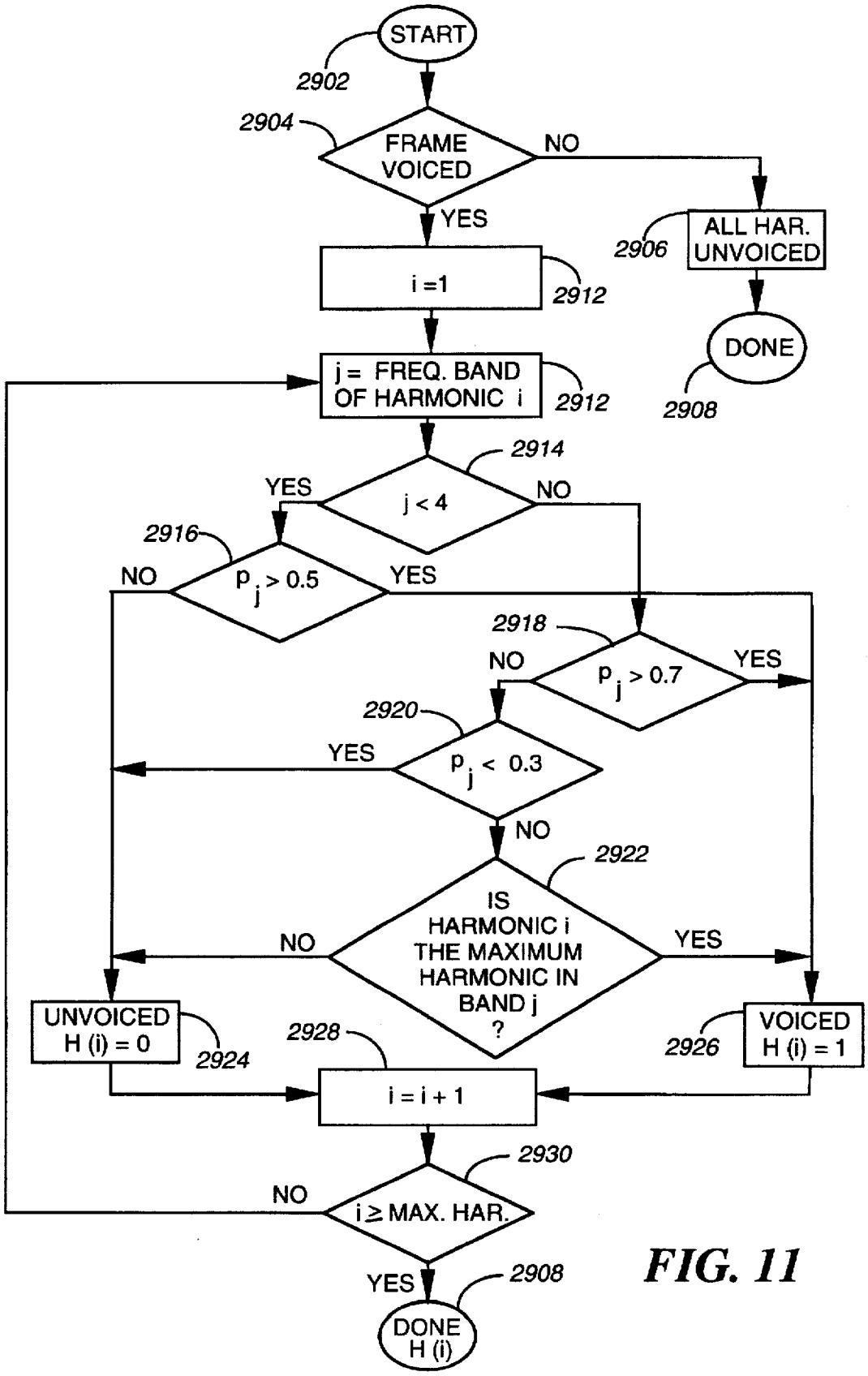
FIG. 11 is a flow chart describing the operation of the voicing controller shown in FIG. 4.

FIG. 11 is a flow chart describing the operation of the multi-band voicing controller 2214 shown in FIG. 4. The voicing controller 2214 examines every harmonic of the pitch signal and generates a variable length binary function, having a bit for each harmonic, indicating the voicing characteristic of each harmonic. The process starts at 2902. Then at 2904 a test of the frame voiced/unvoiced bit, which is part of the thirty-six bit data word stored in the buffer 2202 is made to determine if the frame is designated as voiced or unvoiced. When the frame is designated as unvoiced then at step 2906 all harmonics are designated as unvoiced and the process is completed at step 2908.

When, at step 2904, the frame is designated as voiced then at step 2910 the variable i is initialized to a value of one. Next at step 2912 a determination is made to determine which of the ten MBE bands the harmonic i is falls in and i is set equal to that band. Next at step 2914 a test is made to determine if i is less then a value of 4. When j is less than a value of 4 a test is made at step 2916 to determine if the value of the parameter $P_j$ of the vector P is greater than a value of 0.5. When the value of the parameter $P_j$ is greater than 0.5 the process goes to step 2926 where the value of $H_i$ is set equal to a value of 1. When at step 2916 the value of $P_j$ is not greater than a value of 0.5 the process goes to step 2924 where the value of $H_i$ is set equal to a value of 0.

When at step 2914 the value of j is not less than a value of 4 a test is made at step 2918 to determine if the value of the parameter $P_j$ of the vector P is greater than a value of 0.7. When the value of the parameter $P_j$ is greater than a value of 0.7. The process goes to step 2926 where the value of $H_i$ is set equal to a value of 1.

When at step 2918 the value of the parameter $P_j$ is not greater than a value of 0.7 the process goes to step 2920 where a test is made to determine if $P_j$ is less than a value of 0.3. When the value of $P_j$ is less than a value of 0.3the process goes to step 2924 where the value of $H_i$ is set equal to a value of 0.

When at step 2920 value of $P_j$ is not less than a value of 0.3 the process goes to step 2922 where a test is made to determine if the harmonic $S_i$ is the strongest harmonic in the harmonics in band j. When the harmonic $S_i$ is the strongest harmonic the process goes to step 2926 where the value of $H_i$ is set equal to a value of 1. When the harmonic $S_i$ is not the strongest harmonic the process goes to step 2924 where the value of $H_i$ is set equal to a value of 0.

Following step 2924 and step 2926, at step 2928 the value of i is incremented by one. Next a test is made to determine if the value of i is greater than the number of the maximum harmonic in the function S(i). When the value of i is not greater than the number of the maximum harmonic in the function S(i) the process goes to step 2912 where the voicing determination is made on the next harmonic. When the value of i is not greater than the number of the maximum harmonic in the function S(i) the process is complete at step 2908 where H(i) is returned.

Figure 12:
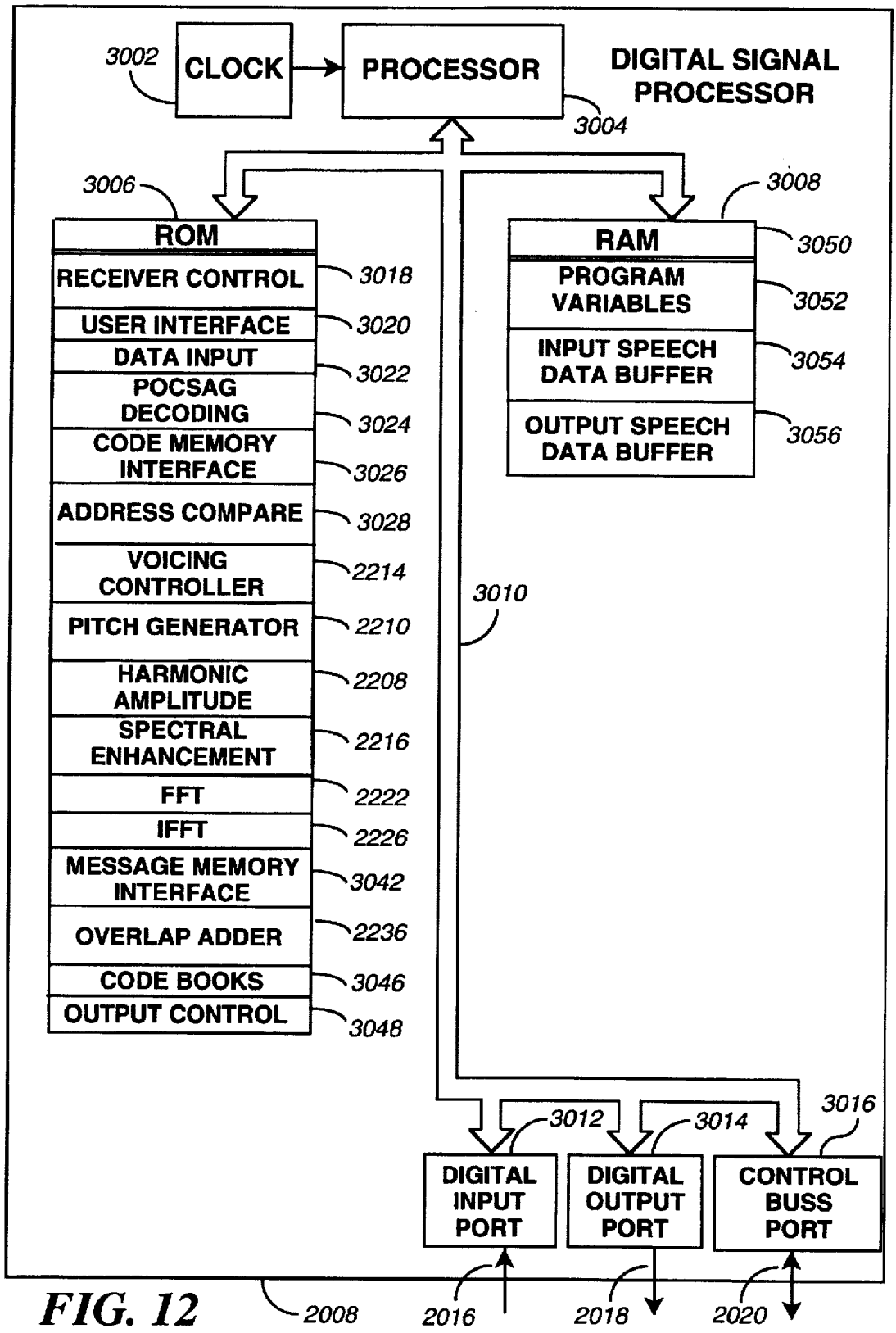
FIG. 12 shows an electrical block diagram of a digital signal processor used in the receiver 114 of FIG. 2.

FIG. 12 shows an electrical block diagram of the digital signal processor 2008 used in the receiver 114 shown in FIG. 2. The processor 3004, is one of several standard commercially available digital signal processor ICs specifically designed to perform the computations associated with digital signal processing. Digital signal processor ICs are available from several different manufactures. One such processor is the DSP56100 manufactured by Motorola Inc. of Schaumburg, Ill. The processor 3004 is coupled to a read only memory (ROM) 3006, a RAM 3008, a digital input port 3012, a digital output port 3014, and a control bus port 3016, via the processor address and data bus 3010. The ROM 3006 stores the instructions used by the processor 3004 to perform the signal processing function required to decompress the message and to interface with the control bus port 3016. The ROM 3006 also contains the instructions to perform the functions associated with compressed voice messaging. The RAM 3008 provides temporary storage of data and program variables. The digital input port 3012 provides the interface between the processor 3004 and the receiver 2004 under control of the data input function. The digital output port 3014 provides the interface between the processor 3004 and the digital to analog converter 2010 under control of the output control function. The control bus port 3016 provides an interface between the processor 3004 and the control bus 2020. A clock 3002 generates a timing signal for the processor 3004.

The ROM 3006 stores by way of example the following: a receiver control function routine 3018, a user interface function routine 3020, a data input function routine 3022, a POCSAG decoding function routine 3024, a code memory interface function routine 3026, an address compare function routine 3028, a processing routine for the multi-band voicing controller 2214, a processing routine for the pitch wave generator 2210, a processing routine for the harmonic amplitude estimator 2208, a processing routine for the spectral enhancement function 2216, a processing routine for the FFT transform generator 2222, a processing routine for the IFFT inverse transform generator 2226, a message memory interface function routine 3042, a processing routine for the overlap adder 2236, an output control function routine 3048 and one or more code books 3046 comprising one or more tables of predetermined spectral vectors 2205 identified by indexes and associated predetermined voicing vectors 2203, as described above.

In summary, speech sampled at an 8 KHz rate and encoded using conventional telephone techniques requires a data rate of 64 Kilo bits per second. However, speech encoded in accordance with the present requires a substantial slower transmission rate. For example speech sampled at a 8 KHz rate and grouped into frames representing 25 milliseconds of speech in accordance with the present invention can be transmitted at an average data rate of 1,440 bits per second. As hitherto stated, the very low bit rate voice messaging system in accordance with the present invention digitally encodes the voice messages in such a way that the resulting data is very highly compressed and can easily be mixed with the normal data sent over a paging channel. The operation of the improved MBE synthesizer in accordance with the present invention provides an apparatus and method for providing multi-band voicing information which is not provided in the transmission of the encoded speech. The improved MBE synthesizer utilizes a unique time domain processing system that reduces processing complexity and time, and provides a natural sounding voice message while artificially generating phase information which is absent in the encoded speech transmission. The improved MBE synthesizer enhances the spectral information to improve the speech quality and reduces noise. In addition, the voice message is digitally encoded in such a way that processing in the receiver is minimized. While specific embodiments of this invention have been shown and described, it can be appreciated that further modification and improvement will occur to those skilled in the art.

We claim:

1. An MBE synthesizer for generating a segment of speech from compressed speech data which is received by a receiver coupled thereto, the compressed speech data which is received includes one or more indexes, the MBE synthesizer comprising:

an excitation generator for generating voiced excitation components and unvoiced excitation components;

a memory for storing a table of predetermined spectral vectors identified by indexes, at least a portion of the table of the predetermined spectral vectors having associated therewith predetermined voicing vectors;

a harmonic amplitude estimator, responsive to one or more predetermined spectral vectors identified by indexes corresponding to the one or more indexes received, and for generating therefrom harmonic amplitude control signals;

a multi-band voicing controller, responsive to the predetermined voicing vectors which are associated with the one or more predetermined spectral vectors identified, for controlling a selection of the excitation components; and a multiplier, for multiplying the harmonic amplitude control signals and the excitation components selected, for generating spectral components representing the segment of speech.

2. The MBE synthesizer according to claim 1, further comprising an input buffer, coupled to the receiver, for storing the compressed speech data including the one or more indexes received.

3. The MBE synthesizer according to claim 1, wherein the predetermined voicing vectors comprise a plurality of voicing parameters, each of the plurality of voicing parameters associated with a band of excitation components.

4. The MBE synthesizer according to claim 3, wherein the plurality of voicing parameters define a likelihood of the band of excitation components as being voiced and unvoiced.

5. The MBE synthesizer according to claim 1, wherein the excitation components which are voiced comprise discrete Fourier voiced amplitude components and discrete Fourier voiced phase components, and wherein the excitation components which are unvoiced comprise discrete Fourier unvoiced amplitude components and discrete Fourier unvoiced phase components.

6. The MBE synthesizer according to claim 5 wherein said multi-band voicing controller controls a selection of phase excitation components from the discrete Fourier voiced phase components and from the discrete Fourier unvoiced phase components, the phase excitation components selected representing spectral phase components, and further controls a selection of amplitude excitation components from the discrete Fourier voiced amplitude components and from the discrete Fourier unvoiced amplitude components, and wherein the MBE synthesizer further comprises a multiplier, for multiplying the harmonic amplitude control signals and the amplitude excitation components selected, for generating spectral amplitude components, and wherein said MBE synthesizer further comprises an inverse transform generator for transforming the spectral phase components and the spectral amplitude components into digitized samples representing the segment of speech.

7. The MBE synthesizer according to claim 1, wherein the compressed speech data further includes frame voicing data identifying that the segment of speech is unvoiced, and wherein said multi-band voicing controller is further responsive to the frame voicing data for controlling the selection of the unvoiced excitation components during the segment of speech.

8. The MBE synthesizer according to claim 1 wherein the table of predetermined spectral vectors having associated therewith predetermined voicing vectors represents a first code book, and wherein said memory further includes a table of predetermined residue vectors representing a second code book.

9. An MBE synthesizer for generating a segment of speech from compressed speech data which is received by a receiver coupled thereto, the compressed speech data which is received including one or more indexes and pitch data, the MBE synthesizer comprising:

an excitation generator utilizing a transform function for generating excitation components which are transformed voiced excitation components and transformed unvoiced excitation components, wherein the generation of the transformed voiced excitation components being responsive to the pitch data;

a memory for storing one or more tables of predetermined spectral vectors identified by indexes;

a harmonic amplitude estimator, responsive to one or more predetermined spectral vectors identified by indexes corresponding to the one or more indexes received, and for generating therefrom harmonic amplitude control signals;

a multi-band voicing controller for controlling a selection of the transformed voiced excitation components and transformed unvoiced excitation components; and a multiplier, for multiplying the harmonic amplitude control signals and the transformed voiced excitation components and transformed unvoiced excitation components selected, for generating spectral components representing the segment of speech.

10. The MBE synthesizer according to claim 9 further comprising an input buffer, coupled to the receiver, for storing the compressed speech data which is received including pitch data.

11. The MBE synthesizer according to claim 9, wherein said excitation generator comprises:

a pitch wave generator for generating a sequence of repetitive digital pitch wave samples in response to the pitch data;

a framer for deriving windowed pitch wave samples by selecting a portion of the sequence of repetitive digital pitch wave samples generated during a window of predetermined duration; and a transform generator for generating transformed voiced excitation components from the windowed pitch wave samples, the transformed voiced excitation components comprising a voiced phase excitation components and a voiced amplitude excitation components.

12. The MBE synthesizer according to claim 11, wherein the sequence of repetitive digital pitch wave samples is defined by a predetermined sequence of data stored with a memory.

13. The MBE synthesizer according to claim 11 further comprising a normalizer, responsive to the voiced amplitude excitation components for maintaining a total energy for the transformed voiced excitation components at a predetermined energy level.

14. The MBE synthesizer according to claim 11, wherein said transform generator generates the voiced excitation components utilizing a discrete Fourier transform of the windowed pitch wave samples, wherein the transformed voiced excitation components represent discrete Fourier voiced amplitude components and discrete Fourier voiced phase components.

15. The MBE synthesizer according to claim 11, further comprising:

a random phase generator and a constant amplitude generator for generating unvoiced excitation components, wherein the unvoiced excitation components generated by said random phase generator represent discrete Fourier unvoiced phase components, and wherein the unvoiced excitation components generated by said constant amplitude generator represent discrete Fourier unvoiced amplitude components.

16. The MBE synthesizer according to claim 9 wherein the table of predetermined spectral vectors has associated therewith predetermined voicing vectors, and wherein said multi-band voicing controller is responsive to the predetermined voicing vectors associated with the one or more predetermined spectral vectors identified, for controlling a selection of the transformed voiced excitation components and transformed unvoiced excitation components.

17. The MBE synthesizer according to claim 9, further comprising an inverse transform generator for transforming the spectral components representing a segment of speech into digitized samples representing the segment of speech.

18. The MBE synthesizer according to claim 9, wherein the compressed speech data further includes frame voicing data identifying that the segment of speech is unvoiced, and wherein said multi-band voicing controller is further responsive to the frame voicing data for controlling the selection of the transformed unvoiced excitation components during the segment of speech.

19. An MBE synthesizer for generating a segment of speech from compressed speech data which is received by a receiver coupled thereto, the compressed speech data which is received including one or more indexes and pitch data, the MBE synthesizer comprising:

an excitation generator for generating transformed voiced excitation components and transformed unvoiced excitation components, wherein the generation of the voiced excitation components being responsive to the pitch data;

a memory for storing one or more tables of predetermined spectral vectors identified by indexes;

a harmonic amplitude estimator, responsive to one or more predetermined spectral vectors identified by indexes corresponding to the one or more indexes received, and for generating therefrom harmonic amplitude control signals which are further associated with harmonics defined by the pitch data which is received, and wherein said harmonic amplitude estimator further comprises a peak detector having a peak magnitude threshold for detecting harmonic amplitude control signals having a magnitude greater than the peak magnitude threshold, a peak enhancer for generating peak enhanced harmonic amplitude control signals by enhancing magnitudes of harmonic amplitude control signals having magnitudes greater then the peak magnitude threshold, a valley detector having a minimum magnitude threshold for detecting peak enhanced harmonic amplitude control signals having a magnitude less than the minimum magnitude threshold, and a valley enhancer for generating enhanced harmonic amplitude control signals by decreasing the magnitudes of the peak enhanced harmonic amplitude control signals having magnitudes less than the minimum magnitude threshold;

a multi-band voicing controller for controlling a selection of the transformed voiced excitation components and transformed unvoiced excitation components; and a multiplier, for multiplying the harmonic amplitude control signals and the transformed voiced excitation components and transformed unvoiced excitation components selected, for generating spectral components representing the segment of speech.

20. The MBE synthesizer according to claim 19, wherein the peak magnitude threshold is a predetermined proportion of a magnitude of a harmonic amplitude control signal having a maximum amplitude within the harmonic amplitude control signals derived from compressed speech data representing a segment of speech.

21. The MBE synthesizer according to claim 19, wherein the peak enhancer generates the peak enhanced harmonic amplitude control signals by multiplying the magnitude of the harmonic amplitude control signals having magnitudes greater than the peak magnitude threshold by a predetermined number.

22. The MBE synthesizer according to claim 19, wherein the minimum magnitude threshold is a lesser of a first predetermined proportion of a first adjacent peak enhanced harmonic amplitude control signal and a second predetermined proportion of a second adjacent peak enhanced harmonic amplitude control signals.

23. The MBE synthesizer according to claim 19, wherein the valley enhancer generates enhanced harmonic amplitude control signals by multiplying the magnitudes of the peak enhanced harmonic amplitude control signals having a magnitude less than the minimum magnitude threshold by a predetermined number.

24. The MBE synthesizer according to claim 23, wherein harmonic magnitudes are the magnitudes of the peak enhanced harmonic amplitude control signals having the magnitudes less than the minimum magnitude threshold and wherein said harmonic amplitude estimator further comprises:

a magnitude comparator for comparing the harmonic magnitudes with a calculated threshold; and a magnitude calculator for generating the enhanced harmonic amplitude control signals by calculating the harmonic magnitudes with a first predetermined formula when the harmonic magnitudes that are greater than the calculated threshold and calculating the harmonic magnitudes with a second predetermined formula when the harmonic magnitudes are greater than the calculated threshold.

25. The MBE synthesizer according to claim 19, wherein said harmonic amplitude estimator is further coupled to an input buffer which is coupled to the receiver, for storing the compressed speech data including the one or more indexes received.

26. An MBE synthesizer for generating a segment of speech from compressed speech data which is received by a receiver coupled thereto, the compressed speech data which is received including one or more indexes, the MBE synthesizer comprising:

a memory for storing a table of predetermined spectral vectors identified by indexes, at least a portion of the table of the predetermined spectral vectors having associated therewith predetermined voicing vectors, wherein the predetermined voicing vectors comprise a plurality of voicing parameters associated with a plurality of bands of spectral information, a voicing parameter identifying a likelihood of a band of the plurality of bands being voiced or unvoiced;

a harmonic amplitude estimator, responsive to the one or more indexes for identifying one or more predetermined spectral vectors, and for generating therefrom harmonic amplitudes coefficients;

multi-band voicing controller, being responsive to the predetermined voicing vector and to the harmonic amplitudes coefficients, for controlling voiced/unvoiced characteristics of each of the plurality of bands of spectral information;

multi-band excitation generator for generating excitation components, the excitation components being divided into a plurality of bands of spectral information; and a multiplier, coupled to the harmonic amplitude estimator and to the multi-band voicing controller, for controlling amplitudes of the excitation components by multiplying the harmonic amplitude coefficients and the excitation components to generate a spectral components representing a segment of speech.

27. The MBE synthesizer according to claim 26, further comprising an input buffer, coupled to the receiver, for storing the compressed speech data including the one or more indexes received.

28. The MBE synthesizer according to claim 26, wherein the voiced excitation components are discrete Fourier voiced amplitude components and discrete Fourier voiced phase components, and wherein the unvoiced excitation components are discrete Fourier unvoiced amplitude components and discrete Fourier unvoiced phase components.

29. The MBE synthesizer according to claim 28 wherein said multi-band voicing controller controls a selection of phase excitation components from the discrete Fourier voiced phase components and from the discrete Fourier unvoiced phase components, the phase excitation components selected representing spectral phase components, and said multi-band voicing controller further controls the selection of amplitude excitation components from the discrete Fourier voiced amplitude components and from the discrete Fourier unvoiced amplitude components; and a multiplier, for multiplying the harmonic amplitude control signals and the amplitude excitation components selected, for generating spectral amplitude components, and wherein said MBE synthesizer further comprises an inverse transform generator for transforming the spectral phase components and the spectral amplitude components into digitized samples representing the segment of speech.

30. The MBE synthesizer according to claim 26, wherein the compressed speech data further includes frame voicing data identifying that the segment of speech is unvoiced, and wherein said multi-band voicing controller is further responsive to the frame voicing data for controlling the selection of the unvoiced excitation components during the segment the segment of speech.

* * * * *